United States Patent [19]

Sommet

[11] Patent Number: 4,878,434

[45] Date of Patent: Nov. 7, 1989

[54] PENETRATING PROJECTILE WITH HARD CORE AND DUCTILE GUIDE AND METHOD OF MAKING IT

[75] Inventor: Pierre Sommet, Sucy en Brie, France

[73] Assignee: Societe Francaise de Munitions, Paris, France

[21] Appl. No.: 275,134

[22] PCT Filed: Feb. 5, 1988

[86] PCT No.: PCT/FR88/00064

§ 371 Date: Oct. 6, 1988

§ 102(e) Date: Oct. 6, 1988

[87] PCT Pub. No.: WO88/06266

PCT Pub. Date: Aug. 25, 1988

[30] Foreign Application Priority Data

Feb. 11, 1987 [FR] France ..... 8701691

[51] Int. Cl.[4] ..... F42B 11/08

[52] U.S. Cl. ..... 102/514; 102/518; 29/1.23; 29/517; 29/419.2

[58] Field of Search ..... 102/501, 507–510, 102/514–519; 29/1.2–1.23, 517, 421 M

[56] References Cited

U.S. PATENT DOCUMENTS

| | | | |
|---|---|---|---|
| 1,322,662 | 11/1919 | Watson | 102/519 |
| 1,709,414 | 4/1929 | Stendeback | 102/519 |
| 1,944,884 | 1/1934 | Gerlich | 102/514 |
| 3,143,966 | 8/1964 | Burns, Jr. et al. | 102/514 |
| 4,708,063 | 11/1987 | Ladriere | 102/516 |
| 4,793,037 | 12/1988 | Carter | 102/507 |

FOREIGN PATENT DOCUMENTS

| | | | |
|---|---|---|---|
| 1072515 | 12/1959 | Fed. Rep. of Germany | 102/514 |
| 496867 | 11/1919 | France . | |
| 18589 | 1/1910 | United Kingdom . | |

*Primary Examiner*—Harold J. Tudor
*Attorney, Agent, or Firm*—Kenyon & Kenyon

[57] ABSTRACT

A penetrating projectile of a caliber less than or equal to 40 mm includes a core (1) provided with a front point (2). The core is made of a hard and/or high density metal or metallic alloy and has a portion (4) to the rear of the point that is surrounded by a ductile metal guide (3) having a substantially cylindrical wall. The portion of the core which is surrounded by the guide is provided with projections (5) and depressions (6), and the guide is crimped onto said portion of the core by electromagnetic forming such that the internal surface of the guide is fixed axially and rotationally to the portion (4) of the core (1) by means of the projections and depressions and the external surface of the guide reproduces the profile of the projections and depressions on the core. The projectile can be produced at low cost and has excellent ballistic properties.

See FIG. 1.

6 Claims, 2 Drawing Sheets d1
2
1
6
7
8
5
d2
d5
6
d3
8
5
d4
9
4
e
10
11
3 d1
2
1
7
6
5
d5
l2
6
d4
4
5
9
d6
l1
3
e

PENETRATING PROJECTILE WITH HARD CORE AND DUCTILE GUIDE AND METHOD OF MAKING IT

The present invention relates to a penetrating projectile of a caliber equal or less than 40 mm.

The object of the invention is equally to provide a cartridge including such a penetrating projectile as well as a method of making the projectile.

Known penetrating projectiles most often comprise a jacket of ductile metal or alloy such as copper or brass which surrounds a core of hard metal such as hardened steel or of tungsten carbide embedded in lead.

The drawback of these projectiles lies in the fact that the attachment between the ductile outer jacket and the hard inner core is imperfect.

Thus, when the projectile is made to rotate under the influence of helical rifling in the barrel of a firearm shooting the projectile, slippage occurs between this jacket and the hard core, which substantially affects the penetrating power of the projectile.

In an embodiment described in French Patent No. 2 536 527, the rear portion of the core of the penetrating projectile is provided with a Morse taper which is socketed in a complementary cone formed in a guide or sabot of ductile metal, which thus comes to partially overlie the hard core.

This mode of assembly permits the achievement of good conditions for rotation of the core, and this projectile thus presents satisfactory penetrating power. Nevertheless, this method of assembly using cones with a Morse taper or auto-clamping cones is difficult to adapt to high volume industrial production. As a matter of fact, the use of Morse taper cones requires very high precision to obtain a perfect fit and without a gap between the guide and the rear face of the core.

In this embodiment, undulations are formed in the external surface of the guide in order to limit the friction between that external surface and the rifling formed in the barrel of a firearm. The creation of these undulations by machining, however, is expensive and involves wasting prime material.

In French Patent No. 2 191 718, there is described a penetrating projectile comprising a hard core, the rear part of which is overlaid by a guide or sabot of ductile material. Bonding of the guide on the core is obtained by soldering, brazing, gluing, casting, or by deposition of metal. These fixing techniques are equally difficult and burdensome to perform on an industrial scale.

In French Patent No. 764 833 a penetrating bullet comprises a hard core surrounded by a soft metal jacket which is attached to the core by means of an embossing or shrinking process which causes the soft metal to penetrate into hollows existing on the surface of the core. However, the external surface of the soft jacket remains smooth in such a way that the jacket presents a high frictional resistance at the time of its passage through a gun barrel.

The object of the present invention is to overcome the drawbacks of the known products by creating a penetrating projectile in which the core and the guide are attached together in a manner such that rotating the assembly takes place under optimal conditions and in which the guide presents undulations on its external surface which reduce the friction of the projectile against a gun barrel, such projectile being easy and inexpensive to manufacture.

The penetrating projectile of a caliber equal to or less than 40 mm which is the aim of the invention comprises a core having a front point, the core being composed of a hard and/or high density metal or metallic alloy, surrounded at the rear of the point by a generally cylindrical guide of ductile metal, the portion of the core which is surrounded by the guide being provided with projections and depressions and the guide being crimped on this portion of the core by radial compression such that the internal surface of the guide is gripped axially and rotationally to that part of the core by means of the projections and depressions of the latter.

According to the invention, the projectile is characterized in that the guide is crimped onto said part of the core by electromagnetic forming and in that said part of the core is provided with undulations, the internal surface of the guide in contact with said part of the core assuming the profile of these undulations and the external surface of the guide reproducing the profile of these undulations, the form of the undulations being predetermined so that their reproductions on the external surface of the guide present desired ballistic properties.

By ductile metal is meant a metal or alloy more ductile than the steel of a gun barrel.

The crimping by electromagentic forming comprises introducing the core surrounded by the guide into a solenoid. The magnetic field generated by the solenoid develops intense forces (Laplace Forces) during several microseconds which not only compress the guide radially onto the core but also produce a true weld, by atomic diffusion, between the guide and the core.

The choice of a ductile metal such as copper or an alloy such as brass for the guide and of steel for the core is optimal for performing electromagnetic forming.

The use of electromagnetic forming thus permits obtaining an excellent bond between the guide and the core, while being perfectly adapted to mass production. As a matter of fact, the dimensions of the guide and of the core do not need to be held to very precise tolerances, given that the deformations generated at the time of crimping permit compensation for dimensional errors.

Moreover, given that the undulations of the core are reproduced, by the electromagnetic forming, in the external surface of the guide, the area of contact is reduced between this external surface and the rifling of a gun barrel. Further given that the undulations are formed in a single operation, at the same time as the crimping by the electromagnetic forming, the fabrication cost of the projectile is sharply less than that of the projectile described in French Patent No. 2 536 527.

According to another aspect of the invention, the process for fabricating a projectile according to the invention preferably comprises the following steps:

providing a core having a front end in the form of a point and a substantially cylindrical portion to the rear of the point of reduced diameter and being formed with depressions and projections;

providing a guide having a generally cylindrical form of which the internal diameter is substantially equal to or slightly larger than the maximum diameter of the reduced diameter portion of the core having depressions and projections;

engaging the guide onto the substantially cylindrical portion of the core;

crimping the guide onto said substantially cylindrical portion of the core by electromagnetic forming, such that the external surface of the guide reproduces the profile of depressions and projections provided on the substantially cylindrical portion of the core.

Thus, starting with a cylindrical guide, it is possible to obtain in one operation, that requires no complementary machining, a perfect mechanical bonding between the guide and the core, and to obtain on the surface of the guide the desired undulating profile for reducing friction with the interior of a gun barrel without affecting the ballistic properties of the projectile.

Other features and advantages of the invention will appear further in the following description.

In the attached drawings, given by way of non-limiting example:

Figure 1:
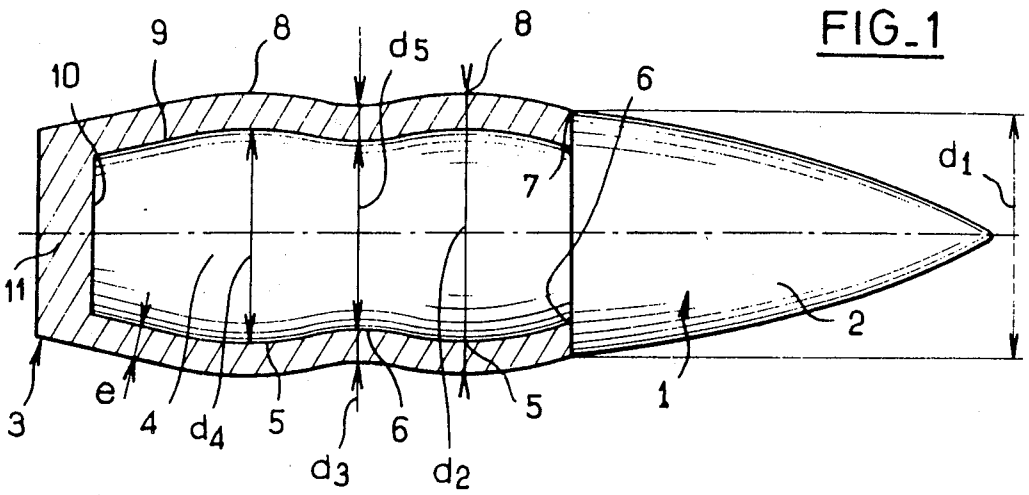
FIG. 1 is a plan view of a core and a longitudinal cross section of a guide of a projectile according to the invention.

In the embodiment of FIG. 1, a penetrating projectile of a caliber less than or equal to 40 mm comprises a core 1 having a front point 2 of conventional ogival form. The core 1 is made of a hard and/or high density metal or metallic alloy such as hardened steel, and a portion to the rear of the point is surrounded by a guide 3 of ductile metal, such as copper or brass, having a generally cylindrical wall. The portion 4 of the core 1 which is surrounded by the guide 3 is provided with projections 5 and depressions 6, and the guide 3 is crimped onto said portion 4 of the core by radial compression, such that the internal surface of the guide 3 is fixed axially and rotationally to the portion 4 of the core by means of the projections 5 and the depressions 6 of the latter.

According to the invention, the guide 3 is crimped onto the portion 4 of the core 1 by electromagnetic forming.

In the illustrative example, the ogival point 2 of the core is joined to the portion 4 surrounded by the guide 3 by an annular shoulder 7 of which the radial extent corresponds substantially to the thickness e of the wall of the guide 3, the edge of the guide being in abutment with the shoulder 7.

Furthermore, as shown in FIG. 1, the projections 5 and the depressions 6 arranged on the portion 4 of the core comprise annular undulations, and the internal surface of the guide 3 in contact with the portion 4 of the core assumes the profile of these undulations. In the same way, the external surface of the guide 3 presents undulations 8 which follow the profile of the undulations 5 arranged on the portion 4 of the core. Thus, the profile of these undulations 5 is predetermined as a function of a desired profile for the external undulations 8 of the guide.

The maximum diameter $d_1$ of the ogival point 2 is slightly less than the traversing caliber of a gun barrel for the projectile.

The maximum diameter $d_4$ of the portion 4 of the core 1 is less than the diameter $d_1$ so that the thickness e of the wall of guide 3 should be sufficient to permit its deformation when it encounters the rifling of a gun barrel. This thickness is in the order of one millimeter. The amplitude of the undulations 8 is between 0.5 and 1 mm.

The undulations 5 arranged on the portion 4 of core 1 are such that the maximum diameter $d_4$ should be equal to $d_2-2e$ ($d_2$ being equal to the caliber of the projectile) and that the minimum diameter $d_5$ of the guide should be equal to $d_3-2e$ ($d_3$ being equal to the minimum diameter of the guide, which is equal to $d_1$ in the example of FIG. 1).

The undulations 8, the profile of which is composed in the example of FIG. 1 by equal circular arcs successively concave and convex, comprise at least two arcs forming bosses which assure perfect guidance of the projectile in the barrel of a gun, while at the same time limiting friction. Moreover, the amplitude of these undulations 8 is sufficiently small and their radius is sufficiently large so as not to affect the aerodynamic characteristics of the projectile.

Figure 2:
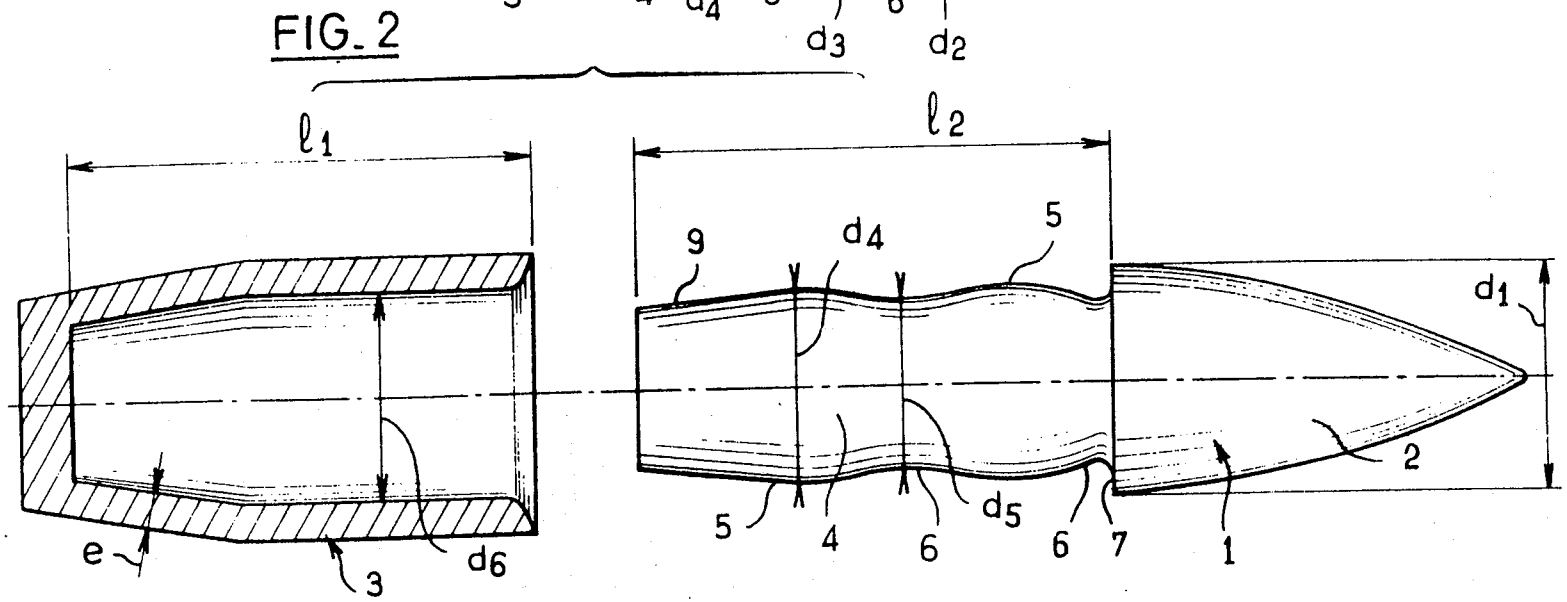
FIG. 2 is an exploded view of the guide and the core before their assembly.

FIG. 2 shows moreover that the portion 4 of core 1 is provided opposite the point 2 with a substantially frusto-conical surface 9 of which the smaller base 10 coincides with the rear end of the portion 4. The internal surface of the guide 3 presents a substantially frusto-conical surface complementary to the substantially frusto-conical surface of the portion 4 of the core, and the guide 3 presents a rear wall 11 flattened against the rear end 10 of the core 1.

Figure 3:
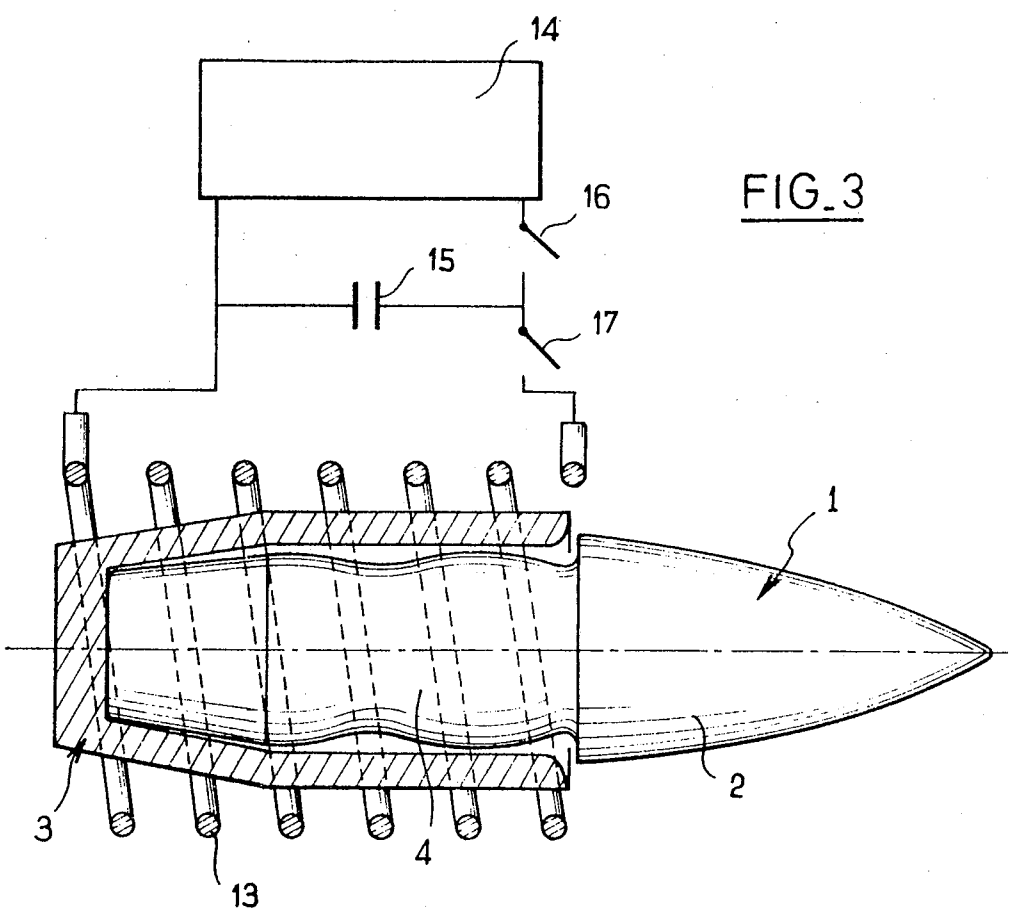
FIG. 3 is a longitudinal cross-sectional view of the guide engaged upon the core, the assembly being inserted into a solenoid of an electromagnetic forming apparatus.

We now proceed to describe, with reference to FIGS. 2 and 3, the process of fabricating a penetrating projectile such as that shown in FIG. 1.

This process comprises the following steps:

providing a core 1 having a front end in the form of a point 2 and a substantially cylindrical portion 4 to the rear of point 2 of reduced diameter and being formed with depressions 6 and with projections 5 obtained, for example, by turning;

providing a guide 3 having a generally cylindrical wall of which the internal diameter is substantially equal to or slightly larger than the maximum diameter $d_4$ of the reduced diameter portion 4 of the core having depressions and projections, the length $l_1$ of the interior cavity of the guide 3 being slightly less than the length $l_2$ of the portion 4 of the core;

subsequently engaging the guide 3 onto the substantially cylindrical portion 4 of the core 1 and crimping the guide 3 onto said substantially cylindrical portion 4 of the core by electromagnetic forming, by means of the apparatus shown schematically in FIG. 3.

This electromagnetic forming apparatus has been described particularly in the journal "CETIM-Informations" NO's. 80–81 of June 1983 entitled "Electromagnetic Forming."

This apparatus comprises a solenoid 13 surrounding the guide 3 engaged onto the portion 4 of the core 1. This solenoid 13 is connected to an electric current generator 14. A capacitor 15 is disposed in parallel with the terminals of the solenoid 13. The electric circuit comprises in further part a charge interrupter 16 and a discharge interrupter 17.

When the charge interrupter 16 is closed and then the discharge interrupter, the solenoid 13 is traversed by a current of a damped sinusoidal form, and a variable magnetic field is created in the interior of the solenoid. This magnetic field creates a force which radially compresses the guide 3 onto the portion 4 of the core. The radial pressure exerted on the guide is substantially given by a relation of the type:

$$P=k.B^2/8\pi$$

where P=pressure (in Pascal)

and B=induction (in Tesla)

Thus, a solenoid creating an induction of 30 Teslas generates a pressure of approximately $7\times10^8$ Pascals, or 7000 bars.

This pressure may appear to be mechanically weak for deforming materials, but given that it is developed in a few microseconds, it sets the material in movement by a strong impulse (instantaneous plastification phenomenon) and then produces large deformations. The conventional laws of resistance of materials are no longer applicable, and it is necessary to turn to the theory of plasticity and to notions such as the "modulus of dynamic elasticity" or "the apparent limit of variable elasticity."

The copper or brass used for the guide 3 and the steel used for the core 1 form a material couple that is ideal for the application of electromagnetic forming. The steel of the core is preferably the steel identified as Z 85 WDCV 6542.

The application of this process, being particularly well suited to large scale industrial production since it does not require pieces machined to very precise tolerances, allows the achievement of a particularly strong and effective bonding between the guide and the core.

Another advantage of this process resides in the fact that it permits in a single operation to reproduce on the surface of the guide 3 the undulations which result in reduced friction with the interior of a gun barrel.

Thus the guide 3 can be obtained from a simple drawn tube. Moreover, the undulations arranged on the core do not need to be machined with precision, because the electromagnetic forming confers a smooth surface to the undulations of the guide, even if the undulations of the core are not machined with high precision. On the contrary, a surface of a core not machined with precision, leaving small irregularities, is favorable to adherence between the guide and the core.

Figure 4:
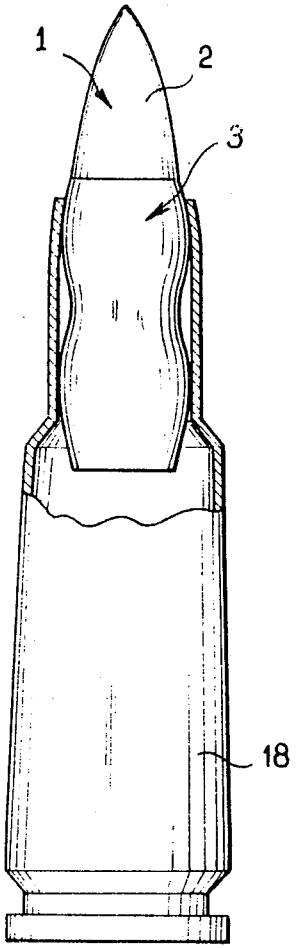
FIG. 4 is a partly cut away elevation view of a cartridge according to the invention.

After completing the process which has just been described, it remains only to insert the projectile into a conventional casing 18 (see FIG. 4) filled with propellant powder to obtain a cartridge ready for use.

It should be understood that the invention is not limited to the embodiments which have just been described, and one can make numerous modifications without departing from the scope of the invention.

Thus, the form of the undulations arranged on the portion 4 of the core 1 can be different from that shown in FIG. 1.

Moreover, the rear end of the guide 3 can be eliminated and the guide formed from a simple drawn tube, which permits a further reduction in the cost of manufacture.

I claim:

1. A penetrating projectile of a caliber no more than 40 mm, the projectile including a core (1) having a front point (2), the core being composed of a hard and high density metallic material and having a portion (4) to the rear of the point surrounded by a guide (3) having a generally cylindrical wall of ductile metal, the metallic material of the core being harder than the metal of the guide and the portion of the core which is surrounded by the guide being provided with projections (5) and depressions (6) and the guide being crimped onto said portion of the core by radial compression such that the internal surface of the guide is fixed axially and rotationally to said portion of the core by means of the projections and depressions, wherein the improvement comprises:

the guide (3) is crimped onto said portion (4) of the core (1) by electromagnetic forming and the projections and depressions on said portion (4) of the core comprise undulations (5,6), the internal surface of the guide (3) in contact with said portion of the core assuming the profile of the undulations (5,6), and the external surface of the guide (3) reproducing the profile of the undulations (5,6).

2. A projectile according to claim 1 wherein the point (2) of the core (1) has an ogival form and wherein the core further comprises an annular shoulder (7) connecting the ogival point (2) with the portion (4) surrounded by the guide (3), the radial extent of the shoulder being substantially equal to or slightly smaller than the thickness (e) of the wall of the guide (3), and the edge of the guide (3) being in abutment with said shoulder (7).

3. A projectile according to one of the preceding claims, wherein the portion (4) of the core (1) to the rear of the point (2) has an end opposite to the point provided with a frusto-conical surface (9) having a small base (10) at the rear end of the core, and the guide (3) has a frusto-conical internal surface that is complementary to the frusto-conical surface of the core.

4. A projectile according to claim 1, wherein the guide has a rear end wall (11) that abuts the rear end (10) of the core (1).

5. A cartridge comprising a casing (18) of a caliber no more than 40 mm in which is inserted a penetrating projectile, the projectile including a core (1) having a front point (2), the core being composed of a hard and high density metallic material and having a portion (4) to the rear of the point surrounded by a guide (3) having a generally cylindrical wall of ductile metal, the metallic material of the core being harder than the metal of the guide and the portion of the core which is surrounded by the guide being provided with projections (5) and depressions (6) and the guide being crimped onto said portion of the core by radial compression such that the internal surface of the guide is fixed axially and rotationally to said portion of the core by means of the projections and depressions, wherein the improvement comprises:

the guide (3) is crimped onto said portion (4) of the core (1) by electromagnetic forming and the projections and depressions on said portion (4) of the core comprise undulations (5,6), the internal surface of the guide (3) in contact with said portion of the core assuming the profile of the undulations (5,6), and the external surface of the guide (3) reproducing the profile of the undulations (5,6).

6. A process for manufacturing a projectile of a caliber no more than 40 mm, the projectile including a core (1) having a front point (2), the core being composed of a hard and high density metallic material and having a portion (4) to the rear of the point surrounded by a guide (3) having a generally cylindrical wall of ductile metal, the metallic material of the core being harder than the metal of the guide and the portion of the core which is surrounded by the guide being provided with projections (5) and depressions (6) and the guide being crimped onto said portion of the core by radial compression such that the internal surface of the guide is fixed axially and rotationally to said portion portion of the core by means of the projections and depressions, the process comprising the following steps:

providing a core (1) having a front end in the form of a point (2) and a substantially cylindrical portion (4) to the rear of the point of reduced diameter and being formed with depressions and projections (5,6);

providing a guide (3) having a generally cylindrical wall of which the internal diameter is substantially equal to or slightly larger than the maximum diameter of the reduced diameter portion (4) of the core having depressions and projections;

engaging the guide (3) onto the substantially cylindrical portion (4) of the core (1);

crimping the guide (3) onto said substantially cylindrical portion of the core by electromagnetic forming, such that the external surface of the guide (3) reproduces the profile of depressions and projections provided on the substantially cylindrical portion (4) of the core.

* * * * *

UNITED STATES PATENT AND TRADEMARK OFFICE

CERTIFICATE OF CORRECTION

PATENT NO. : 4,878,434

DATED : November 7, 1989

INVENTOR(S) : SOMMET

It is certified that error appears in the above-identified patent and that said Letters Patent is hereby corrected as shown below:

Column 6, line 66 change: "portion portion" to --portion--.

Signed and Sealed this

Eleventh Day of June, 1991

*Attest:*

HARRY F. MANBECK, JR.

*Attesting Officer*

*Commissioner of Patents and Trademarks*